US005612306A

United States Patent [19]

O'Brien et al.

[11] Patent Number: 5,612,306

[45] Date of Patent: Mar. 18, 1997

[54] STABLE ENZYME-CONTAINING AQUEOUS LAUNDRY PRESPOTTING COMPOSITION

[75] Inventors: Jeanne A. O'Brien; Mark M. Gipp, both of Racine, Wis.

[73] Assignee: S. C. Johnson & Son, Inc., Racine, Wis.

[21] Appl. No.: 539,647

[22] Filed: Oct. 5, 1995

Related U.S. Application Data

[63] Continuation-in-part of Ser. No. 215,219, Mar. 21, 1994, abandoned.

[51] Int. Cl.[6] ..... C11D 3/386

[52] U.S. Cl. ..... 510/321; 510/392; 510/530; 510/405; 510/488; 435/188

[58] Field of Search ..... 252/124.12, DIG. 12, 252/174.21, DIG. 19, 173; 510/392, 530, 321, 405, 488; 435/188

[56] References Cited

U.S. PATENT DOCUMENTS

| | | | |
|---|---|---|---|
| 4,243,546 | 1/1981 | Shaer | 510/393 |
| 4,285,841 | 8/1981 | Barrat et al. | 510/321 |
| 4,302,364 | 11/1981 | Gosset et al. | 510/321 |
| 4,318,818 | 3/1982 | Letton et al. | 428/43 |
| 4,362,638 | 12/1982 | Caskey et al. | 252/90 |
| 4,404,115 | 9/1983 | Tai | 510/393 |
| 4,438,009 | 3/1984 | Brusky et al. | 252/90 |
| 4,462,922 | 7/1984 | Boskamp | 510/393 |
| 4,595,527 | 6/1986 | Gipp et al. | 252/546 |
| 4,648,987 | 3/1987 | Smith et al. | 252/559 |
| 4,670,179 | 6/1987 | Inamorato et al. | 510/321 |
| 4,711,739 | 12/1987 | Kandathil | 252/139 |
| 4,842,769 | 6/1989 | Shulman et al. | 510/321 |
| 4,909,962 | 3/1990 | Clark | 252/542 |
| 4,959,179 | 9/1990 | Aronson et al. | 510/393 |
| 5,156,773 | 10/1992 | Kochavi et al. | 510/393 |
| 5,186,856 | 2/1993 | Holland | 252/143 |
| 5,205,960 | 4/1993 | Kristopeit et al. | 252/174.24 |
| 5,211,496 | 6/1993 | Holland | 252/143 |
| 5,221,495 | 6/1993 | Cao | 510/321 |
| 5,221,496 | 6/1993 | Holland | 510/284 |
| 5,223,179 | 6/1993 | Connor | 134/25.2 |
| 5,269,960 | 12/1993 | Gray et al. | 510/303 |
| 5,288,421 | 2/1994 | Mandy et al. | 252/121 |

FOREIGN PATENT DOCUMENTS

| | | |
|---|---|---|
| 1243784 | 8/1971 | United Kingdom . |
| 2131826 | 12/1983 | United Kingdom . |
| WO91/13142 | 9/1991 | WIPO . |

OTHER PUBLICATIONS

Novo's Handbook of Practical Biotechnology (Novo Industri A/S, 1986) [2nd Edition], pp. 54–57.

Home Laundering Pre–Wash Spotter Stain Removal [CSMA Designation DCC–11], May 1981.

*Primary Examiner*—Margaret Einsmann

*Assistant Examiner*—Kery A. Fries

[57] ABSTRACT

A stable, enzyme-containing aqueous laundry prespotting composition. The composition includes at least one detergent enzyme in an amount effective to reduce fabric stains; an enzyme stabilizing system effective to preserve the detergent enzyme for at least 12 weeks at at least 90° F. in an amount effective to reduce fabric stains, the enzyme stabilizing system including at least one chelating agent and at least one nonionic surfactant, with no additional enzyme stabilizer; and an aqueous carrier.

24 Claims, No Drawings

STABLE ENZYME-CONTAINING AQUEOUS LAUNDRY PRESPOTTING COMPOSITION

This is a continuation-in-part of application Ser. No. 08/215,219, filed Mar. 21, 1994, now abandoned.

FIELD OF THE INVENTION

This invention relates to stable, enzyme-containing aqueous laundry prespotting compositions. More particularly, this invention relates to enzymatic aqueous laundry prespotting compositions that have simple enzymatic stabilizer systems such that the need to employ additional enzymatic stabilizers or stabilizing systems is avoided, but which compositions nevertheless exhibit long-term enzyme storage stability and effective stain removing properties.

BACKGROUND ART

Typical laundry prespotting compositions that are aqueous-based are designed to remove various water-borne stains, including grape juice, mustard, grass, chocolate, clay, and similar stains. Such formulations can lack effectiveness in removing oil-borne stains, including stains from cooking oil, fat, spaghetti sauce, sebum, grease, motor oil, and the like.

One highly successful commercial aqueous laundry prespotting composition that has been marketed as LIQUID SHOUT® is described in U.S. Pat. No. 4,595,527, issued Jun. 17, 1986. This composition exhibits precleaning properties for both oil and water-borne stains. The composition includes, among other things, effective amounts of a chelating agent, a nonionic surfactant, and water. The use of enzymes is not expressly precluded but also is not suggested.

It is known that the introduction of enzymes in heavy duty liquid detergents helps improve the wash performance of these products for certain stains. Thus, proteases improve the removal of protein-based stains, such as blood, egg, and grass stains. Amylase improves the wash efficiency for starch stains, such as those caused by gravy. Lipases are effective in removing triglyceride-based stains, such as cooking oil, fat, and sebum stains and the like.

However, there are inherent problems with employing cleaning compositions containing enzymes. When an enzyme is added to an aqueous medium without steps taken to stabilize the enzyme, the enzyme typically is rapidly denatured in the water. Consequently, a loss of enzyme activity is observed over time. Accordingly, in order to provide commercially practical aqueous enzyme detergent compositions, the art has found it necessary to stabilize the enzymes so that they retain their activity for long periods of shelf-storage time.

Many means and formulations have been proposed to stabilize enzymes present in water-based compositions. For example, in U.S. Pat. No. 4,243,546, issued Jan. 6, 1981, a stabilizing system for an enzyme is disclosed that includes an alkanolamine and an acid. In U.S. Pat. No. 4,318,818, issued Mar. 9, 1982, it is disclosed that a calcium salt, a short chain carboxylic acid such as a formate, and an alcohol can be employed to stabilize an aqueous enzyme composition. It is of interest to note that in the '818 patent, column 7, lines 20–23, it is stated that the enzyme-containing composition must be substantially free of sequestrants, such as polyacids and chelating agents. Such sequestrants in amounts over about 1% by weight are identified as undesired, since they remove enzyme-stabilizing calcium from the composition by forming calcium complexes.

In U.S. Pat. No. 4,404,115, issued Sep. 13, 1983, it is proposed to employ a boron-containing enzyme stabilizer, such as an alkali metal borate, in the enzymatic aqueous cleaning compositions of the patent. It is also disclosed that other stabilizers, such as an alkali metal sulphite and/or a polyol, preferably also are present. The '115 patent also teaches use of builders, such as tripolyphosphates, EDTA, citrates and the like. However, the patent also discloses that when such builders were employed in the absence of a borate stabilizer, comparative tests showed that there was no enzyme activity remaining after only two weeks storage at elevated temperatures. Similar results are illustrated in U.S. Pat. No. 4,462,922, issued Jul. 31, 1984. Thus, these patents teach that enzymes are stable in the presence of the chelating builders disclosed only if the borate enzyme stabilizer also was present.

In Novo's Handbook of Practical Biotechnology, 2nd Edition, pp. 54–57, published by Novo Industri A/S (Denmark) in 1986, it is disclosed that enzyme stability is enhanced by the presence of calcium, alcohols, and other stabilizers. It is also disclosed that builders (generally metal-chelating agents) bind ions such as calcium and effectively remove them from solution. Sodium citrate is referred to as an example of such a compound. The Novo Handbook states that such builders or chelating agents destabilize enzymes. In addition, on pages 55 and 56, the Novo Handbook recommends that in order to obtain good enzyme stability, the water level of the product should not be too high. A water level of 55% by weight or less is recommended. In Novo's U.S. Pat. No. 5,156,773, issued Oct. 20, 1992, it is also taught that the presence of detergent builders reduces the storage stability of liquid enzymatic detergents.

From these examples, it is seen that the clear expectation of the art has been that chelating agents destabilize enzymes and must not be used except in very small amounts in the absence of enzyme stabilizing systems. However, in direct opposition to this restriction on the use of chelating agents, it is considered otherwise desirable for cleaning purposes to employ chelating agents as builders in laundry cleaning compositions to assist in controlling mineral hardness and to enhance the surfactancy of nonionic detergents contained in the compositions. This is a basic conflict in needs, and the various and generally multi-ingredient enzyme stabilizing formulations of the art are intended to address this conflict.

However, the need to employ extra enzyme stabilizing ingredients has important practical disadvantages in that it adds to the cost of enzyme-containing laundry cleaning compositions in an industry in which even small incremental increases in production costs can cause a formulation not to be competitive in the marketplace. It is therefore desirable to create an enzyme laundry cleaning composition that includes a chelating agent but that is substantially free of enzymatic stabilizers beyond a specific, limited enzymatic stabilization system, in order to obtain the enzyme stain removal and other cleaning advantages of the formulation but also to reduce cost and maintain market competitiveness by omitting the use of avoidable ingredients.

SUMMARY OF THE INVENTION

It is, therefore, a primary object of the present invention to provide a stable enzyme-containing aqueous laundry composition that is substantially free of enzymatic stabilizers beyond a specific, limited enzymatic stabilization system.

It is another object of the invention to provide such a stable enzymatic aqueous laundry prespotting composition that provides enhanced stain removal and enzyme stability properties in combination with effective builder levels.

It is a further object of the present invention to provide a stable enzymatic aqueous laundry prespotting composition having enhanced storage stability even in the presence of significant amounts of water.

Still further objects and advantages of the composition of the present invention will become more apparent from the following description thereof.

It has been surprisingly found that a stable, enzyme-containing aqueous laundry prespotting composition may be made that exhibits enhanced enzyme stability and useful stain removing properties but that is at least substantially free of enzymatic stabilizers beyond a specific, limited enzymatic stabilization system. The composition includes an aqueous carrier, at least one detergent enzyme, and an enzymatic stabilization system that may be limited to (i) a chelating agent in amounts effective to enhance long-term storage stability and to provide effective stain removing properties and (ii) at least one nonionic surfactant.

The compositions of the present invention are generally liquids of viscosities varying from thin compositions, suitable primarily for use as pump spray or squeeze bottle spray compositions, to thick formulations, including gels, that may be spread on cloth by some alternative method.

DETAILED DESCRIPTION OF THE INVENTION

Contrary to the practice of the art, it has been surprisingly found that an enzyme-containing aqueous laundry prespotting composition can be successfully made that is substantially free from various materials known to the art as enzyme stabilizers, including formates, acetates, polyols, boron compounds, calcium compounds, and the like. So long as the simple and minimal enzymatic stabilization system of the invention is used, the prespotting composition is stable and quite effective, even when entirely free of such additional enzyme stabilizers, previously thought necessary by the art. Although such additional stabilzers are not required to achieve enzyme stability in the composition of the invention, they may well not be functionally harmful in that they may well not reduce the enzyme stability of the composition of the invention. Nevertheless, because they have now been discovered to be avoidable, their inclusion would add expense not necessary for enzyme stability and that therefore would have to be justified by their serving other functions.

It is preferred that enzymes be retained in effective concentrations within laundry prespotting compositions for as much as a full year, in that it can be reasonably anticipated that some consumers will still be using a bottle of prespotter that long after its manufacture. However, the majority of product may be expected to have been used much earlier than that. A commercially useful enzyme stability shall be deemed to have been achieved if enzymes are preserved in effective concentrations for not less than twelve weeks even when stored in temperatures of as high as 90° F.

More specifically, the composition of the invention achieves commercially useful enzyme stability together with stain removal that is enhanced over the same composition without enzymes by providing an enzymatic cleaning composition that includes a detergent enzyme and water when, in addition to the detergent enzyme and water, a chelating agent and at least one nonionic surfactant are employed. It is an unexpectedly obtainable advantage that additional, enzyme stabilizing ingredients are not required to compensate for the chelating agent, which is known to the art as an enzyme destabilizer. Indeed, to achieve the cost efficiency of the invention, the additional ingredients must be avoided. Thus, the invention alternatively may be described as an enzyme-containing aqueous composition including an enzyme stabilizing system consisting essentially of a chelating agent and at least one nonionic surfactant. The detergent enzyme remains stable even in enzymatic laundry formulations that employ high levels of water.

The stable, enzyme-containing aqueous composition of the invention preferably includes (a) from about 0.1 to 6% by weight of at least one chelating agent; (b) from about 5 to 40% by weight of at least one nonionic surfactant; and (c) from about 0.1 to 5% by weight of a detergent enzyme; with (d) the balance being water and with additional enzyme stabilizing ingredients or systems being absent.

The chelating agent of the present invention serves a variety of functions. It assists in removing certain heavy ions that inhibit the surfactancy of the nonionic surfactants. In addition, contrary to the prior teaching of the art, the chelating agent also unexpectedly appears to improve the stability of the detergent enzyme in the aqueous composition. In fact, the chelating agent also appears to improve the performance of the enzymatic composition in stain removal. These properties are truly surprising in that conventional wisdom dictated that chelating agents destabilize enzymes in aqueous solution. See for example the discussion in the Background Art section, above, of Novo's Handbook of Practical Biotechnology, 2nd Edition, and U.S. Pat. No. 5,156,773.

Chelating agents useful in the present invention include lactic acid; the salts of ethylenediamine tetraacetic acid (EDTA), such as ethylenediamine tetraacetic acid disodium salt, ethylenediamine tetraacetic acid diammonium salt, ethylenediamine tetraacetic acid trisodium salt, ethylenediamine tetraacetic acid tetrasodium salt, ethylenediamine tetraacetic acid tetrapotassium salt, ethylenediamine tetraacetic acid tetrammonium salt and the like; the salts of diethylenetriaminepentaacetic acid (DTPA), such as diethylenetriaminepentaacetic acid pentapotassium salt and the like; the salts of (N-hydroxyethyl) ethylenediaminetriacetic acid (HEDTA), such as (N-hydroxyethyl) ethylenediaminetriacetic acid trisodium salt, (N-hydroxyethyl) ethylenediaminetriacetic acid tripotassium salt and the like; the salts of nitrilotriacetic acid (NTA), such as nitrilotriacetic acid trisodium salt, nitrilotriacetic acid tripotassium salt and the like; other chelating agents such as triethanolamine, diethanolamine, monoethanolamine and the like, and mixtures thereof. However, because of its low cost and effectiveness, the preferred chelating agent is citric acid.

As indicated, the chelating agents, especially the EDTA, DTPA, and HEDTA types, can be added to the composition of the present invention in salt form. Indeed, this is generally preferred, since the salts are water soluble. If the chelating agents are added in water insoluble, free acid form, the free acids must be at least partially neutralized to make them water soluble and form the chelating agent salts in situ. Suitable bases to neutralize the free acids are potassium hydroxide, ammonium hydroxide, and sodium hydroxide, which is preferred.

In general, sufficient base is added to solubilize the free acid chelating agent and to bring the pH of the composition of the invention within the range of from about 5 to 9.5. Typically, a pH from about 6 to 8 achieves the best results. It may be necessary to add an additional pH buffering material to the composition to adjust the pH within the desired range. In general, organic and inorganic acids can be employed for such purposes, such as oxalic acid, acetic acid, hydrochloric acid, phosphoric acid, and the like.

For best results, the chelating agents of the present invention are present in amounts from about 0.1 to 6% by weight, although somewhat greater or lesser amounts can be employed depending on the nature and levels of nonionic surfactant and/or enzyme selected. Within this range, optimum stability is imparted to the composition and optimum cleaning and prespotting efficiency is obtained. It is more preferred that the chelating agents be employed in amounts from 0.9 to 4% by weight and, most preferably, from 1 to 3% by weight.

The detergent enzyme to be incorporated can be a proteolytic, amylolytic, lipolytic, or cellulolytic enzyme, as well as mixtures thereof. Such enzymes can be of any suitable origin, such as vegetable, animal, bacterial, fungal, and yeast origins. While the detergent enzymes can be incorporated in the present composition in any suitable form, such as granules or as a slurry, it is preferred that they be employed as a liquid concentrate.

The ultimate choice of enzyme is generally governed by several factors including pH activity, stability optima, thermostability, and stability versus active detergents, chelating agents, and the like. In this respect, bacterial or fungal enzymes are preferred, including bacterial amylases, fungal cellulases, and, especially, bacterial proteases.

Suitable examples of the preferred bacterial proteases are the subtilisins, which are obtained from particular strains of *B. subtilis* and *B. licheniforms*. A preferred protease sold by Novo Industries under the tradename Esperase is obtained from a strain of Bacillus. The preparation of this enzyme and analogous enzymes is described in British Patent Specification No. 1,243,784 of Novo.

Proteolytic enzymes that are commercially available and usable herein and are suitable for removing protein-based stains include those sold under the tradenames Alcalase and Savinase by Novo Industries and Maxapem and Maxacal by International Biosynthetics Inc. of the Netherlands, now a subsidiary of Gist-Brocades. Particularly preferred protease enzymes are sold under the tradename Durazym by Novo Industries and Maxapem by Gist Brocades.

Suitable amylases, cellulases, and lipase enzymes are well-known and are disclosed, for example, in U.S. Pat. No. 5,223,179, issued Jun. 29, 1993.

In general, enzyme is present in the composition of the invention in an effective amount sufficient to provide stain removal properties. An "effective amount" of an ingredient shall be understood as that amount that achieves the purposed function of the ingredient. Preferably the amount of enzyme, as a percentage by weight, is from about 0.1 to 5%, more preferably from 0.2 to 2%, and most preferably from 0.3 to 1%.

The compositions of the present invention also include at least one nonionic surfactant. A single nonionic surfactant or mixtures of nonionic surfactants can be employed. Preferably, to achieve optimum efficiency, the nonionic surfactant or mixture of such surfactants has an HLB within the range from 9 to 13 and, more preferably, from 10 to 12.

Suitable nonionic surfactants include the ethoxylated octylphenols, including those members of the Triton X Series available from Union Carbide Corporation that fall within the desired HLB range; ethoxylated fatty alcohols, including the ethoxylated primary fatty alcohols such as the Neodols available from Shell Chemicals; ethoxylated secondary fatty alcohols such as the Tergitol Series available from Union Carbide; and, most preferably, the ethoxylated nonylphenols such as the Surfonic N series available from Huntsman Specialty Chemicals Corporation. If desired, ethoxylated sorbitan fatty acid esters, such as the Tweens from ICI America, and sorbitan fatty acid esters, such as the Spans from ICI America, can be added.

Preferred surfactants include the ethoxylated octylphenols having from 3 to 10 moles of ethylene oxide. The particularly preferred surfactants include those ethoxylated nonylphenols having a degree of ethoxylation from 3 to 10 moles of ethylene oxide and the ethoxylated fatty alcohols having 3 to 10 moles of ethylene oxide.

In general, the compositions of the invention include from about 5 to 40% by weight of at least one nonionic surfactant, although the exact amount employed will be a function of the other ingredients selected and of the viscosity and form of the composition desired. It is particularly preferred to employ from about 8 to 35% by weight of at least one nonionic surfactant in the composition.

The amount of aqueous carrier, preferably water, employed in the composition depends, in part, on the desired form of the inventive composition. In general, water is employed in amounts from about 55 to 95% by weight of the composition. When a gel form of the composition is desired, the amount of water is preferably from about 55 to 80% by weight. If a liquid form of the composition is desired, the amount of water preferably employed is from 80% to 95% by weight.

In general, it has been found that tap water is preferable, although it is also satisfactory to use either dechlorinated water or deionized water. Test results have shown that tap water provides best stability for enzymes, presumably because of the presence of various metal ions.

If desired, the composition of the present invention can also include small amounts of other conventional materials that do not affect enzyme stability, including perfumes, defoamers, bacteriacides, bacteriastats, thickeners, and the like. In general, such materials are usually present in amounts less than 2% by weight.

Although the present compositions are primarily designed for use as prespotting compositions, they can also be used as laundry detergents or cleaning agents, including heavy duty liquid laundry cleaning compositions.

The compositions of the present invention can be prepared by any conventional means. Suitable methods include cold blending or other mixing processes.

In the Examples that follow, the stain-removing effects of the present invention are measured using staining materials and test cloth swatches, in accordance with accepted industry standards. When grass was employed as the cloth swatch staining material, a grass slurry was prepared according to CSMA Performance Test Methods For Cleaning Products-CSMA Designation DCC-11 for Home Laundering Pre-Wash Spotter Stain Removal. In this test 50 grams of grass dippings, 500 grams water, and 50 grams isopropyl alcohol were utilized. The grass and water were placed in a blender, and gradually blender speed was increased to liquefy the mass and form a slurry. The isopropyl alcohol was added, as needed, to decrease foam, and additional blending was conducted for 20 minutes. The remainder of the isopropyl alcohol was then added, and the slurry was agitated for 5 minutes. The mixture was drained through a 40 mesh screen and refrigerated prior to use.

The stained test swatches were visually evaluated according to the rating system in the Home Laundering Pre-Wash Spotter Stain Removal test method designated CSMA-DCC-11. In this rating system, an AATCC Stain Release Replica is utilized as the standard to which the residual stain on the test specimen is compared. Ratings from 1 to 5 are utilized. A rating of 5 means there is no residual stain, while a rating of 1 means a residual stain equivalent to Replica 1, which is the most intense stain and is equivalent to essentially no stain removal.

The prespotting compositions of the present invention will now be illustrated by way of the following examples, where all percentages are by total weight of composition and all temperatures are in ° F. unless otherwise indicated.

EXAMPLE 1

Aqueous laundry prespotting compositions were prepared having the following ingredients:

TABLE 1

| Ingredient | Amount | | | | | |
|---|---|---|---|---|---|---|
| Sample # | 1A | 1B | 1C | 1D | 1E | 1F |
| Water | 88.0 | 87.0 | 89.95 | 88.95 | 91.9 | 90.9 |
| Citric Acid (50% actives) | 2.4 (1.2)[1] | 2.4 (1.2) | 1.2 (0.6) | 1.2 (0.6) | — | — |
| NaOH (50% actives) | 1.5 (0.75) | 1.5 (0.75) | 0.75 (0.38) | 0.75 (0.38) | — | — |
| Ethoxylated nonylphenol (6 moles ethylene oxide) | 8 | 8 | 8 | 8 | 8 | 8 |
| Protease enzyme (Durazym 16.0 L Type EX) | — | 1.0 | — | 1.0 | — | 1.0 |
| Fragrance | 0.1 | 0.1 | 0.1 | 0.1 | 0.1 | 0.1 |

[1]Actives amount

The stain removal results are illustrated in the following Table 1A:

TABLE 1A

| Sample | Stain Removal (Grass Stains) |
|---|---|
| Ex. 1A | 1.5 |
| Ex. 1B | 4.0 |
| Ex. 1C | 1.0 |
| Ex. 1D | 3.5 |
| Ex. 1E | 1.0 |
| Ex. 1F | 3.0 |

In Sample 1 E, no chelating agent or enzyme was present. In Samples 1A and 1 C, no enzyme was employed. In Sample 1F, no chelating agent was employed. When both a chelating agent and an enzyme were employed, as in Samples 1B and 1D, stain removals were remarkably enhanced. Where only an enzyme but not a chelating agent was employed, as in Sample 1 F, grass stain removal was improved but not to the extent observed when both a chelating agent and enzyme of the invention were employed.

EXAMPLE 2

The procedure of Example 1 was repeated except that the formulations were changed as indicated in Table 2. Formulations 2A–2C contained decreasing amounts of chelating agent, while Formulations 2D and 2E did not contain an enzyme. Formulation 2F did not contain either a chelating agent or an enzyme.

TABLE 2

| Ingredient | Amount | | | | | |
|---|---|---|---|---|---|---|
| Sample | 2A | 2B | 2C | 2D | 2E | 2F |
| Water | 86.985 | 88.945 | 90.895 | 87.985 | 89.945 | 91.895 |
| Citric Acid (50% actives) | 2.400 | 1.200 | — | 2.400 | 1.200 | — |
| NaOH (50% actives) | 1.510 | 0.750 | — | 1.510 | 0.750 | — |
| Ethoxylated nonylphenol (6 moles ethylene oxide) | 8.000 | 8.000 | 8.000 | 8.000 | 8.000 | 8.000 |
| Durazym[1] | 1.000 | 1.000 | 1.000 | — | — | — |
| Antifoam | 0.001 | 0.001 | 0.001 | 0.001 | 0.001 | 0.001 |
| Preservative | 0.004 | 0.004 | 0.004 | 0.004 | 0.004 | 0.004 |
| Fragrance | 0.100 | 0.100 | 0.100 | 0.100 | 0.100 | 0.100 |

[1]As in Example 1

Each of the Formulations 1A–1F was tested on a 100% cotton swatch that had been stained with a grass stain slurry prepared by the CSMA method. The swatches were stained, allowed to set overnight, and washed with Purex detergent, a commercially available detergent that does not contain enzymes. The prespotter formulations were individually applied, allowed to sit for one minute, and then washed. The stain removal characteristics were rated on the 1 to 5 scale of the AATCC Stain Release Replica, with 1 being essentially no removal and 5 being complete removal in accordance with the CSMA standard DCC- 11.

The formulations were tested in accordance with the procedure of Example 1. The test results are reported in Table 2A. The enzyme activity of the formulations was measured after individual storage at room temperature, 70° F., and/or 90° F., as indicated in the Table. Similarly, stain removal was also measured after the formulations had been stored for the indicated periods at 70° (considered room temperature, or "RT"), and/or 90° F. The swatches tested were either 100% cotton or a blend of 65/35 polyester/cotton.

TABLE 2A

| Sample | Storage Period Weeks | Enzyme Activity % Remaining RT/70° F. | Enzyme Activity % Remaining 90° F. | Stain Removal RT/70° F. | Stain Removal 90° F. |
|---|---|---|---|---|---|
| 2A | 0 | 100% | — | 3.5/4.0[1] | — |
| 2A | 12 | 72 | 43 | — | — |
| 2A | 16 | 71 | 44 | — | — |
| 2A | 20 | — | — | 3.5/4.0[1] | 3.5/4.0[1] |
| 2A | 52 | 43 | 40 | 4.0[2] | 3.0[2] |
| 2B | 0 | 100% | — | 3.5/4.0[1] | — |
| 2B | 12 | 70 | 35 | — | — |
| 2B | 16 | — | — | — | — |
| 2B | 20 | — | — | 3.5/4.0[1] | 3.0/4.0[1] |
| 2B | 52 | 35 | 35 | 3.5[2] | 4.0[2] |
| 2C | 0 | 100% | — | 3.5/4.0[1] | — |
| 2C | 12 | 52 | 26 | — | — |
| 2C | 16 | — | — | — | — |
| 2C | 20 | — | — | 3.5/3.5[1] | 2.5/2.5[1] |
| 2C | 52 | 38 | 39 | 2.5[2] | 2.0[2] |
| 2D | 0 | | | 2.0/2.5[1] | — |
| 2E | 0 | | | 1.5/2/5[1] | — |
| 2F | 0 | | | 1.5/2.5[1] | — |

[1]100% cotton swatch/65–35% polyester-cotton swatch
[2]100% cotton swatch

The test results indicate that the formulation with the highest chelating agent level, Sample 2A, was the most stable for enzyme activity over time.

The results also demonstrate that, as chelating agent level is reduced, the formulation becomes less efficient in stain removal. Where no chelating agent was present, the results showed (Sample 2C) that the enzyme loses its activity quickly and that stain removal, especially after prolonged storage, is substantially reduced. In Samples 2D–2F, where no enzyme was present, the amount of chelating agent has a slight impact on the level of grass stain removal, particularly with regard to cotton.

The instant inventors found that similar results were obtained when linear alcohol ethoxylates were substituted for the nonylphenol ethoxylates.

EXAMPLE 3

In order to show the effect of different protease enzymes on stain removal and to illustrate storage stability, formulations were prepared that were identical to Sample 2A of Example 2, with the exception that different enzymes were substituted. The formulations were then tested according to the procedure of Example 1. Their activity and stain removal properties after thirty-two weeks of being stored at 70° (considered room temperature, or "RT"), and/or 90° F. are reported in Table 3.

TABLE 3

| Enzyme and Sample Number | Storage Temperature | Percent Enzyme Activity Remaining | Stain Removal |
|---|---|---|---|
| Durazym (3A) | RT | 34 | — |
| | 90 | 35 | — |
| Savinase (3B) | RT | 31 | 4.0 |
| | 90 | 39 | 3.5 |
| Alcalase (3C) | RT | 46 | 2.5 |
| | 90 | 48 | 2.0 |
| Maxapem (3D) | RT | 59 | 4.0 |
| | 90 | 33 | 3.5 |

The results demonstrate that stain removal is satisfactory when other protease enzymes are substituted for Durazym.

EXAMPLE 4

In order to show the effect of employing different ranges of both chelating agent and surfactant, various formulations were prepared having the ingredients of the formulation of Sample 2A of Example 2, except that the amount of chelating agent was varied between 0.1% and 6% by weight, and the surfactant levels were varied from 5% to 40% by weight. The test results showed that, within such ranges, the grass stain removal value was generally from 3.0 to 4.0. The formulations varied in form from thin liquids to gels, depending on the amount of surfactant present.

EXAMPLE 5

The following is an example of a formulation for a laundry pre-spotter made in accord with the invention that represents the best commercial mode of the invention, in the present understanding of the inventors. All ingredient amounts are expressed as weight percentages of the total formulation.

| Ingredient: | Weight percent |
|---|---|
| Water | 79.212 |
| Linear alcohol ethoxylate | 11.800 |
| Citric acid | 5.18 |
| NaOH | 3.17 |
| Protease enzyme | 0.40 |
| Silicone anti-foamer | 0.001 |
| Preservative | 0.037 |
| Fragrance | 0.100 |
| Polymeric thickener | 0.100 |

The examples are intended to be illustrative only. Alternative embodiments within the scope and breadth of the invention will be apparent to those skilled in the art. Therefore, the invention is not to be limited except as set forth in the following claims.

We claim:

1. A stable, enzyme-containing aqueous laundry prespotting composition comprising:

a. at least one detergent enzyme in amounts effective to reduce fabric stains;

b. an enzyme stabilizing system effective to preserve the detergent enzyme for at least 12 weeks at at least 90° F. in an amount effective to reduce fabric stains, the enzyme stabilizing system including citric acid and at least one nonionic surfactant, with from 0% to less than 2% by weight of other materials that further maintain enzyme stability; and c. an aqueous carrier where a detergent enzyme shall be deemed to be in an amount effective to reduce stains if a rating of at least 2 is attained for grass stain removal from cotton fabric under the Home Laundering Pre-Wash Spotter Stain Removal test method designated CSMA-DCC-11.

2. The composition of claim 1, in which the detergent enzyme is a protease.

3. The composition of claim 1, in which the nonionic surfactant is selected from the group consisting of ethoxylated nonylphenols, ethoxylated octylphenols and ethoxylated fatty alcohols.

4. The composition of claim 1, in which the chelating agent is present in amounts from about 0.1 to 6% by weight.

5. The composition of claim 1, in which the nonionic surfactant is present in amounts from about 5 to 40% by weight.

6. The composition of claim 1, in which the detergent enzyme is present in amounts from about0.1 to 5% by weight.

7. The composition of claim 1, in which the aqueous carrier is water.

8. A stable, enzyme-containing aqueous laundry prespotting composition comprising:

(a) from about 0.1 to 5% by weight of at least one detergent enzyme;

(b) an enzyme stabilizing system including from about 0.1 to 6% by weight of citric acid, and from about 5 to 40% by weight of at least one nonionic surfactant, with from 0% to less than 2% by weight of other materials that further maintain enzyme stability; and (c) the balance comprising water.

9. The composition of claim 8, in which the detergent enzyme includes a protease.

10. The composition of claim 8, in which the nonionic surfactant is selected from the group consisting of ethoxylated nonylphenols, ethoxylated octylphenols and ethoxylated fatty alcohols.

11. The composition of claim 10, in which the nonionic surfactant is an ethoxylated nonylphenol.

12. The composition of claim 10, in which the nonionic surfactant is an ethoxylated octylphenol.

13. The composition of claim 10, in which the nonionic surfactant is an ethoxylated fatty alcohol.

14. The composition of claim 8, in which the chelating agent is present in amounts from about 0.9 to 4% by weight.

15. The composition of claim 14, in which the chelating agent is present in amounts from about 1 to 3% by weight.

16. The composition of claim 8, in which the detergent enzyme is present in amounts from about 0.2 to 2% by weight.

17. The composition of claim 16, in which the detergent enzyme is present in amounts from about 0.3 to 1% by weight.

18. The composition of claim 8 having a pH in the range from about 5 to 9.5.

19. The composition of claim 8, in which said water is present in amounts from about 55 to 95% by weight.

20. The composition of claim 19, in liquid form wherein water is present in amounts from 80% to 95% by weight.

21. The composition of claim 19, in gel form wherein water is present in amounts from 55 to 80% by weight.

22. An aqueous laundry composition comprising:

a. an aqueous carrier and an effective amount of at least one detergent enzyme for reducing fabric stains; and b. an enzyme stabilizing system consisting essentially of citric acid and at least one nonionic surfactant, the composition including from 0% to less than 2% by weight of other materials that further maintain enzyme stability, where a detergent enzyme shall be deemed to be in an amount effective to reduce fabric stains if a rating of at least 2 is attained for grass stain removal from cotton fabric under the Home Laundering Pre-Wash Spotter Stain Removal test method designated CSMA-DCC-11.

23. The composition of claim 22 wherein the enzyme stabilizing system is effective to preserve the detergent enzyme for at least 12 weeks at at least 90° F. in an amount effective to reduce fabric stains.

24. A method of stabilizing a detergent enzyme in an aqueous laundry composition comprising the step of contacting the detergent enzyme in an aqueous carrier with an enzyme stabilizing system effective to preserve the detergent enzyme for at least 12 weeks at at least 90° F. in an amount effective to reduce fabric stains, the enzyme stabilizing system including at least one chelating agent and at least one nonionic surfactant, with from 0% to less than 2% by weight of other materials that further maintain enzyme stability.

* * * * *